US005932408A

United States Patent [19]

Saitou

[11] Patent Number: 5,932,408

[45] Date of Patent: Aug. 3, 1999

[54] SILVER HALIDE EMULSION

[75] Inventor: Mitsuo Saitou, Minami Ashigara, Japan

[73] Assignee: Fuji Photo Film Co., Ltd., Kanagawa, Japan

[21] Appl. No.: 08/819,441

[22] Filed: Mar. 17, 1997

Related U.S. Application Data

[63] Continuation of application No. 08/554,108, Nov. 6, 1995., abandoned, which is a continuation of application No. 08/226,982, Apr. 13, 1994., abandoned

[30] Foreign Application Priority Data

Apr. 22, 1993 [JP] Japan ..... 5-096250

[51] Int. Cl.[6] ..... G03C 1/005

[52] U.S. Cl. ..... 430/567; 430/569

[58] Field of Search ..... 430/567, 569

[56] References Cited

U.S. PATENT DOCUMENTS

| | | | |
|---|---|---|---|
| 5,264,337 | 11/1993 | Maskasky | 430/567 |
| 5,275,930 | 1/1994 | Maskasky | 430/567 |
| 5,314,798 | 5/1994 | Brust et al. | 430/567 |
| 5,320,938 | 6/1994 | House et al. | 430/567 |
| 5,413,904 | 5/1995 | Chang et al. | 430/569 |
| 5,756,276 | 5/1998 | Shirai | 430/567 |

*Primary Examiner*—Thorl Chea

*Attorney, Agent, or Firm*—Birch, Stewart, Kolasch & Birch, LLP

[57] ABSTRACT

A silver halide emulsion comprising at least a dispersion medium and silver halide grains is disclosed, wherein the silver halide grains comprise tabular grains having, as the main planes, {100} planes and having an aspect ratio (diameter/thickness) of 1.5 or more, in a proportion of 10% or more of the sum of the projected areas of all the grains, and the tabular grains each has at least one discontinuous halogen composition gap plane in their central part in such a way that the gap involves at least a difference of from 10 to 100 mol % in terms of the $Cl^-$ content or the $Br^-$ content or a difference of from 5 to 100 mol % in terms of the $I^-$ content between the adjacent layers. The reproducibility of the emulsion is good. The emulsion has high sensitivity, good graininess and good ability of forming high-quality photographic images.

11 Claims, 1 Drawing Sheet

SILVER HALIDE EMULSION

This application is a continuation of application Ser. No. 08/554,108 filed on Nov. 6, 1995, now abandoned, which is a continuation of application Ser. No. 08/226,982, filed on Apr. 13, 1994, now abandoned.

FIELD OF THE INVENTION

The present invention relates to a silver halide (hereinafter referred to as "AgX") emulsion useful in the field of photography and, in particular, to an emulsion containing tabular AgX grains having novel structures.

BACKGROUND OF THE INVENTION

Photographic materials having tabular AgX grains have improved color sensitivity, sharpness, light-scattering characteristics, covering power, rate of development and graininess than those having non-tabular AgX grains. Accordingly, tabular AgX grains having twin planes parallel to each other and having, as the main planes, {111} planes have become used generally. For the details of such grains, the disclosures in JP-A-58-113926, JP-A-58-113927, JP-A-58-113928 and JP-A-2-28638 (corresponding to U.S. Pat. Nos. 4,439,520, 4,434,226 4,434,226 and 4,945,037, respectively), and JP-A-2-838 and JP-A-2-298935 are referred to. (The term "JP-A" as used herein means an "unexamined published Japanese patent application".) However, where AgX grains adsorb large amounts of sensitizing dyes, in general, those having {100} planes have better color-sensitizing characteristics. Therefore, it is desired to develop tabular AgX grains having, as the main planes, {100} planes. Such {100} tabular grains having right-angled, parallelogramic main planes are described in, for example, JP-A-51-88017 and JP-B-64-8323 (corresponding to U.S. Pat. Nos. 4,063,951 and 4,386,156, respectively), and EP-A-0534395. (The term "JP-B" as used herein means an "examined Japanese patent publication".) However, none of these grains have a discontinuous halogen composition gap plane in their central part. Instead, these grains have a uniform halogen composition or a gradually varying halogen compositions throughout. It is difficult to get good controllability of tabular grain production so that the dispersion of the intended grains is significant in preparing them and, additionally, only AgX emulsions having broad grain size distributions are prepared. These conventional AgX grains are not satisfactory with respect to their sensitivity and graininess and also their ability of forming high-quality photographic images.

SUMMARY OF THE INVENTION

The object of the present invention is to provide an AgX emulsion containing AgX grains which may be reproduced with high reproducibility and which have high sensitivity, good graininess and good ability of forming high-quality photographic images.

The object of the present invention has been attained by a silver halide emulsion comprising at least a dispersion medium and silver halide grains, wherein the silver halide grains comprise tabular grains having, as the main planes, {100} planes and having an aspect ratio (diameter/thickness) of 1.5 or more, in a proportion of 10% or more of the sum of the projected areas of all the grains, and the tabular grains each has at least one discontinuous halogen composition gap plane in their central part in such a way that the gap involves at least a difference of from 10 to 100 mol % in terms of the $Cl^-$ content or the $Br^-$ content or a difference of from 5 to 100 mol % in terms of the $I^-$ content between the adjacent layers.

As one preferred embodiment of the present invention, the $Cl^-$ content of all the tabular grains in the emulsion is 49 mol % or less.

As another preferred embodiment of the present invention, the gap involves a difference of from 10 to 100 mol % in terms of the $Br^-$ content.

The silver halide emulsion of the present invention containing tabular grains having, as the main planes, {100} planes and having an aspect ratio (diameter/thickness) of 1.5 or more may be prepared by a method comprising at least the grain formation and step of the invention Ostwald ripening, with grain formation being effected by a double-jet method of adding silver salt solutions and halide solutions in two or more steps in such a way that the difference in the halogen composition between the halide solutions to be added in the adjacent steps is at least from 10 to 100 mol % in terms of the $Cl^-$ content or the $Br^-$ content or from 5 to 100 mol % in terms of the $I^-$ content.

DETAILED DESCRIPTION OF THE INVENTION

Figure 1:
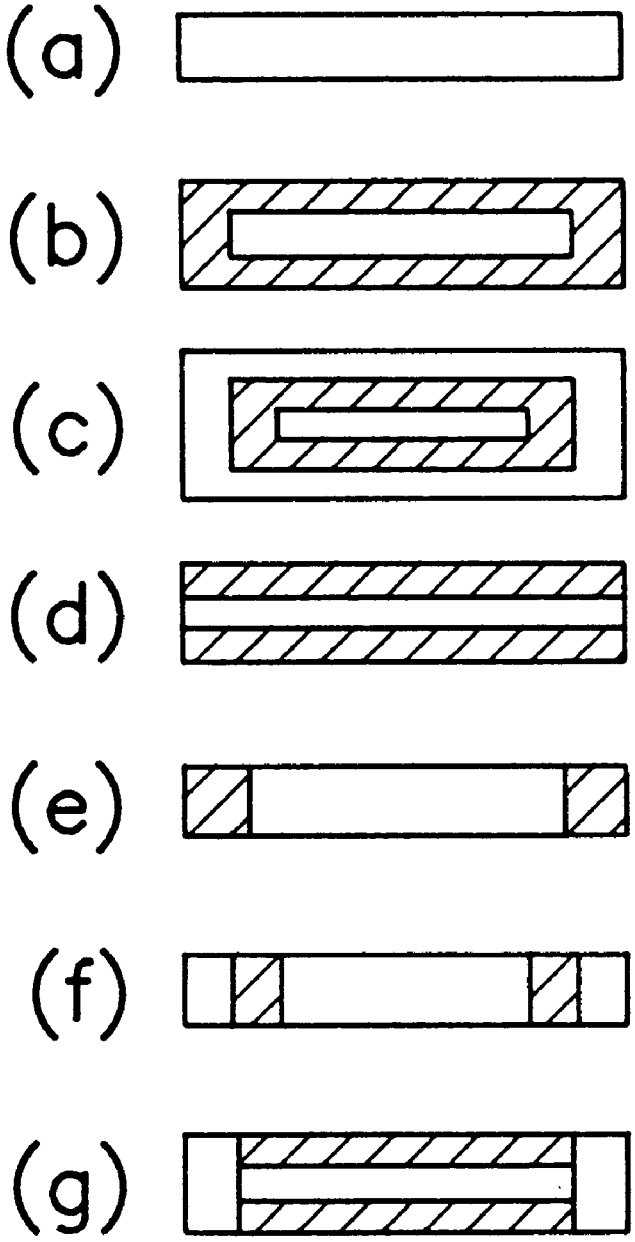
FIG. 1(*a*)–(*g*) shows examples of seven kinds of different halogen composition structures in the inside of silver halide grains, in which the shadow area and the white area indicate different halogen compositions.

First, the structures of the AgX grains of the present invention will be explained in detail, and thereafter the method of preparing AgX emulsions containing such grains will be explained in detail. The projected area as referred to herein means a projected area of each of AgX grains which have been disposed on a substrate in such a way that the grains do not overlap with one another and that the main planes of the tabular grains in them are made parallel to the surface of the substrate.

The tabular grains of the present invention have defects of anisotropic growth and their seed grains have therein at least one halogen composition gap plane where the halogen compositions discontinuously vary between the adjacent layers. Due to the formation of the gap plane(s), the amount of the defects to be formed in the tabular grains of the present invention is controlled. Therefore, the AgX emulsion of the present invention, comprising at least a dispersion medium and AgX grains, is characterized in that the AgX grains comprise tabular grains having, as the main planes, {100} planes, having an aspect ratio (diameter/thickness) of 1.5 or more and having defects of anisotropic growth, in a proportion of 10% or more of the sum of the projected areas of all the grains and that their defects have been created by forming one or more discontinuous halogen composition gap plane between the adjacent layers in their seed grains, the halogen composition gap being defined to involve at least a difference of from 10 to 100 mol % in terms of the $Cl^-$ content or the $Br^-$ content or a difference of from 5 to 100 mol % in terms of the $I^-$ content between the adjacent layers.

A. Structures of AgX Grains

The AgX emulsion of the present invention comprises at least a dispersion medium and AgX grains, and the AgX grains therein comprise tabular grains having, as the main planes, {100} planes and having an aspect ratio (diameter/thickness) of 1.5 or more, preferably 2 or more, more preferably from 3 to 25, especially preferably from 3 to 7, in a proportion of 10% or more, preferably from 30 to 100%, more preferably from 60 to 100%, of the sum of the projected areas of all the grains, and the tabular AgX grains have at least one discontinuous halogen composition gap plane between the adjacent layers in their central part. The diameter of the tabular AgX grains as referred to herein means a diameter of a circle having the same area as the projected area of the grain when the grains are observed with an electronic microscope. The thickness thereof means the distance between the main planes of the tabular grain. The thickness is preferably 0.7 μm or less, more preferably from 0.03 to 0.3 μm, especially preferably from 0.05 to 0.2 μm.

The grain size of the tabular grain is 10 μm or less, preferably from 0.2 to 5 μm, more preferably from 0.2 to 3 μm, in terms of the diameter of the circle corresponding to the projected area of the grain. The total halogen composition of the tabular grain is not specifically defined, provided that the grains have halogen composition gap(s) in their central part. Therefore, the grains may have any unlimited AgBrClI composition, but preferably have an AgCl content of 49 mol % or less, more preferably 40 mol % or less, especially preferably 30 mol % or less. If the AgCl content in them is not less than 50 mol %, it is preferred that the gap in the grains involves the difference in the $Br^-$ content but not in the $I^-$ content.

Regarding the grain size distribution of the tabular grains of the present invention, it is preferred that the grains are monodispersed in such a way that the fluctuation coefficient of the grain size distribution (standard deviation/mean grain size) is 0.4 or less, preferably 0.3 or less, more preferably from 0 to 0.2.

The tabular grains of the present invention each has one or more, preferably from 1 to 4, more preferably one or two halogen composition gap planes.

1) Embodiment of Tabular AgX Grains Having One Halogen Composition Gap Plane

For example, there are mentioned AgCl/AgBr grains where AgBr has been laminated on the AgCl nucleus, AgCl/AgBrI grains where AgBrI has been laminated on the AgCl nucleus, and AgClBr/AgBr grains where AgBr has been laminated on the AgClBr nucleus. In general terms, these are represented by $AgX_1/AgX_2$, where $X_1$ and $X_2$ are different from each other by from 10 to 100 mol %, preferably from 30 to 100 mol %, more preferably from 50 to 100 mol %, further preferably from 70 to 100 mol %, in terms of the $Cl^-$ content or the $Br^-$ content, or by from 5 to 100 mol %, preferably from 10 to 100 mol %, more preferably from 30 to 100 mol %, further preferably from 50 to 100 mol %, in terms of the $I^-$ content.

Further mentioned are such that the difference in the $Cl^-$ content or that in the $Br^-$ content satisfies the defined range and that the difference in the $I^-$ content is from 0 to 5 mol %. In these cases, it is preferred that $X_1>X_2$ in terms of the $Cl^-$ content.

2) Embodiment of Tabular AgX Grains Having Two Halogen Composition Gap Planes

For example, there are mentioned AgBr/AgCl/AgBr grains, AgBrI/AgCl/AgBrI grains, AgCl/AgBr/AgCl grains and AgBr/AgBrI/AgBr grains, referring to the way of expressing the halogen compositions mentioned above. In general terms, these are represented by $AgX_1/AgX_4/AgX_3$, in which $X_1$ and $X_3$ may be the same or different. The halogen composition gap between the adjacent layers satisfies the definitions mentioned above. The gap planes between the adjacent layers each involves a discontinuous difference in the halogen composition between the adjacent layers. More concretely, the discontinuous difference indicates that the halogen compositions of halide solutions (hereinafter referred to as "$X^-$ salt solutions") that are added along with a silver salt solution by a double jet method during the grain formation step vary at the gap plane of the grains in accordance with the definitions mentioned above. It is preferred that the halogen composition gap(s) in the above-mentioned embodiments 1) and 2) involves the difference in the $Br^-$ content. More preferably, the grains have two gap planes each involving the difference in the $Br^-$ content.

It is preferred that the tabular grains of the present invention do not have the gap plane involving the difference in the $I^-$ content.

The optimum molar ratio of $AgX_1$:$AgX_2$ for the $AgX_1/AgX_2$ grains and that of $AgX_1$:$AgX_4$:$AgX_3$ for the $AgX_1/AgX_4/AgX_3$ grains can be selected by design of experiment to give the best mode of the present invention.

The diameter of the projected area of the grain nucleus, which corresponds to the diameter of a circle having the same area as the projected area, is preferably 0.3 μm or less, more preferably 0.15 μm or less, further preferably from 0.02 to 0.1 μm. The central part of the grain indicates the nucleus thereof having the gap plane(s) formed during seed grain formation.

In the embodiment 1), the thickness of the $AgX_2$ layer is preferably such that the layer may cover the surface of the underlying $AgX_1$ layer in an amount of 0.1 lattice layer or more, more preferably one lattice layer or more, further preferably from three lattice layers to $10^3$ molar times the molar amount of the $AgX_1$ layer, on average.

In the embodiment 2), the molar amount of the $AgX_4$ layer to be added is preferably from 0.02 to 10 molar times, more preferably from 0.1 to 3 molar times, as large as the molar amount of the $AgX_1$ layer to be added.

The especially preferred ranges of the relative amounts of $AgX_1$ through $AgX_4$ vary, depending on the halogen compositions and the sizes of the seed grains, the sizes of the gaps, the temperatures, the pH and pAg and the concentrations of the dispersion media used during formation of the gap planes, etc. Accordingly, it is preferred that the optimum relative amounts of them are determined by trial-and-error according to the individual cases. For the $AgX_1/AgX_2$ grains, the defects may be created by laminating a large amount of an $AgX_2$ phase over fine $AgX_1$ grains, or alternatively, they may be created by laminating a small amount of an $AgX_2$ phase over $AgX_1$ grains. It is preferred that the tabular grains have the same gap structure. This is because the tabular grains having the same gap structure have a constant ratio (a) of (number of screw dislocations/grain) and have a narrow grain size distribution.

Grain structures include, as shown in FIG. 1, (*a*) a structure having a uniform halogen composition, (*b*) a two-layered structure where the halogen compositions differ between the core layer and the shell layer, and (*c*) a multi-layered structure composed of a core layer and two or more shell layers. For the structures (*b*) and (*c*), the $Br^-$ content or the $I^-$ content in the outermost layer may be lower than or higher than that in the inner layer(s). These may be used suitably in accordance with the intended object. For the structures having a higher $Br^-$ content or $I^-$ content in the surface of the grain, referred to are JP-A-3-148648, JP-A-2-123345, JP-A-2-12142 and JP-A-1-284848. For the structure (*c*), for example, mentioned is one embodiment where the $I^-$ content or the $Br^-$ content in the interlayer may be higher than that in the outermost layer. For the embodiment, referred to are JP-A-60-35726 and JP-A-60-258536.

In addition, further mentioned are (*d*) a sandwich structure where different halogen composition layers have been laminated only on the top and bottom main planes of a tabular grain, (*e*) or (*f*) a structure where different halogen composition layers have been laminated only on the both edges of a tabular grain, and a composite structure composed of two or more of (*b*) through (*f*), such as the structure (*g*).

The variation in the halogen composition between the layers may be a gradually increasing one, a gradually decreasing one or a rapidly increasing or decreasing one, which may be selected in accordance with the object. Regarding this, referred to are JP-A-63-220238, JP-A-59-45438, JP-A-61-245151, JP-A-60-143331 and JP-A-63-92942. The difference in the $I^-$ content between the layers is preferably 1 mol % or more, more preferably from 2 to 10 mol %. The difference in the $Cl^-$ content between them is preferably 1 mol % or more, more preferably from 5 to 70 mol %, further preferably from 10 to 70 mol %. The thickness of the outermost layer and that of the interlayer are preferably 3 lattice layers or more, more preferably from 12 lattice layers to 0.5 $\mu$m. One lattice layer as referred to herein indicates the distance between the centers of the two $(Ag^+)$'s in $Ag^+$-X_-$Ag^+$. However, in the grain structures illustrated herein the halogen composition gap in the central part is not shown but has been omitted.

The shape of the main planes of the tabular grains may be anyone of a right-angled parallelogram (in which the ratio of the adjacent sides corresponding to the ratio of (length of the major side)/(length of the minor side) in one grain is preferably from 1 to 10, more preferably from 1 to 5, further preferably from 1 to 2), a shape derived from a right-angled parallelogram by asymmetrically deleting the four angles therefrom (its details are described in Japanese Patent Application No. 4-145031) and a shape derived from a four-sided figure constituting the main plane by outwardly curving at least two facing sides.

B. Method of Preparing AgX Emulsion of the Present Invention

The AgX emulsion of the present invention is prepared at least by seed grain formation and ripening of the formed seed grains.

First, the seed grain formation step will be explained.

(1) Seed Grain Formation Step:

An $AgNO_3$ solution and a halide (hereinafter referred to as an $X^-$ salt) solution are added to a dispersion medium solution containing at least a dispersion medium and water while stirring, for seed grain formation.

During the seed grain formation step, defects which cause the anisotropic growth of the grains are created. The defect is herein referred to as a screw dislocation. For creating the screw dislocations, it is necessary that the seed grain forming atmosphere is an atmosphere for creating {100} planes so that the seed grains formed may have {100} crystal planes. AgCl nuclei formed under ordinary conditions may have {100} crystal planes, if no particular adsorbents or conditions are employed. Therefore, the screw dislocations may be created in AgCl seed grains under ordinary conditions. Particular adsorbents and particular conditions as referred to herein are such that twin planes are created or octahedral AgCl grains are formed when they are employed. For these, referred to are U.S. Pat. Nos. 4,399,215, 4,414,306, 4,400,463, 4,713,323, 4,804,621, 4,783,398, 4,952,491 and 4,983,508, *Journal of Imaging Science*, Vol. 33, 13 (1989), ibid., Vol. 34, 44 (1990), and *Journal of Photographic Science*, Vol. 36, 182 (1988).

However, AgBr seed grains may have {100} planes only when they are formed under limited conditions. The limited conditions are generally known as conditions for forming cubic or tetradecahedral AgBr grains. The screw dislocations may be created under the limited conditions. In this case, the tetradecahedral grains formed are such that the ratio ($x_1$) of (area of {111} plane)/(area of {100} plane is preferably from 1 to 0, more preferably from 0.3 to 0, further preferably from 0.1 to 0. The characteristics of AgBrCl grains are considered to vary in proportional to the $Br^-$ content therein. Accordingly, the conditions for seed grain formation becomes more limited with an increase of the $Br^-$ content therein. The above-mentioned ratio ($x_1$) of the areas may be measured, for example, by employing a method of utilizing the plane-selective adsorption dependence of sensitizing dyes to the {111} plane and the {100} plane (refer to T. Tani, *Journal of Imaging Science*, Vol. 29, 165 (1985)).

Apart from the above, a {100} plane formation accelerator may be used during the seed grain formation step and the following steps so as to accelerate the formation of the {100} plane. For specific examples of the accelerator and the method of using it, referred to is EP-A-0534395. Briefly, an adsorbent having a nitrogen atom with resonance-stabilized π-electron pairs is added to the dispersion medium solution in an amount of from $10^{-5}$ to 1 mol/liter, preferably from $10^{-4}$ to $10^{-1}$ mol/liter, and the seed grain formation is carried out at pH larger than the value of (pKa of the adsorbent compound −0.5), preferably larger than the pKa value, more preferably at pH of (pKa +0.5) or larger.

The concentration of the dispersion medium in the dispersion medium solution to be used for the seed grain formation step is from 0.1 to 10% by weight, preferably from 0.2 to 5% by weight; the pH in the same is from 1 to 12, preferably from 2 to 11, more preferably from 5 to 10; and the $Br^-$ concentration in the same is $10^{-2}$ mol/liter or less, preferably $10^{-2.5}$ mol/liter or less. The temperature during the seed grain formation step is preferably 90° C. or lower, more preferably from 15 to 80° C. The $Cl^-$ concentration in the same solution is preferably $10^{-1}$ mol/liter or less.

The seed grain formation step is carried out under the above-mentioned {100} plane-forming atmosphere whereby the screw dislocations are introduced into the formed seed grains. In the present invention, one or more, preferably from 2 to 4, more preferably two halogen composition gap planes are formed in the seed grains, whereby the screw dislocations are introduced into the seed grains. This is to forcedly introduce the screw dislocations into the seed grains, utilizing the misfit of the lattice constants between the adjacent layers generated in the gap plane. This is superior to the method described in EP-A-0534395 with respect to the reproducibility. In the European Patent, there is disclosed a method of introducing $I^-$ having an extremely large ionic radius into AgCl lattices and a method of utilizing coagulation of seed grains, but the reproducibility by these methods is poor. In addition, since the introduction of $I^-$ into AgCl lowers the processing capacity of developers, it is especially unfavorable. On the other hand, since introduction of $Br^-$ into AgCl or introduction of $I^-$ into AgBr does not almost create screw dislocations in the seed grains, the usable systems are limited. Hence, the disclosed methods has such various drawbacks.

According to the present invention, concretely, a silver salt solution and an $X^-$ salt solution are added to the dispersion medium by a double jet method to cause the seed grain formation, while the halogen composition of the $X^-$ salt solution is discontinuously varied during the period of the seed grain formation. For instance, the period of the seed grain formation is divided into two stages, and the halogen compositions of the $X^-$ salt solutions to be added in the first stage and the next stage are discontinuously varied in accordance with the degree of the halogen composition gap that has been hereinbefore described in the above-mentioned A. Alternatively, the period of seed grain formation is divided into three stages, and the halogen compositions of the $X^-$ salt solutions to be added in the first, second and third stages are discontinuously varied in accordance with the degrees of the halogen composition gaps that have been hereinbefore described in the above-mentioned A. In more general terms, the period of seed grain formation is divided into n stages (where n is an integer of 2 or more), and the halogen compositions of the $X^-$ salt solutions to be added in the adjacent stages are discontinuously varied in accordance with the degrees of the halogen composition gaps that have been hereinbefore described in the above-mentioned A. The ratio (a) of (number of screw dislocations formed)/(grain) depends on the difference in the halogen composition between the adjacent layers via the halogen composition gap, the thicknesses of the $AgX_1$ , $AgX_2$ and $AgX_3$ layers, the pH, pAg and temperature during seed grain formation, and the concentrations of the dispersion medium and adsorbent used during seed grain formation.

Apart from the above, additionally mentioned are the following methods. To form the $AgX_1/AgX_2$ seed grains, $AgX_1$ seed grains are first formed, and thereafter an $X^-$ salt solution is added thereto, causing halogen conversion of the $AgX_1$ nuclei to thereby yield the intended $AgX_1/AgX_2$ seed grains. In this case, it is preferred that the $X^-$ salt has a halide composition capable of forming a more hardly-soluble salt than the $AgX_1$. This method is preferably employed, since only the addition of the $X^-$ salt solution is needed to form the defects and therefore the reaction system is simpler and the formation of the defects is more uniform in different grains.

Further mentioned is another method where $AgX_1$seed grains are first formed, then an $X^-$ salt solution is added thereto, and thereafter an $Ag^+$ salt solution is added thereto to obtain the intended $AgX_1/AgX_2$ seed grains.

The formation of the different AgX phases may be conducted under the same or different conditions. However, it is more preferred that the first formation of the $AgX_1$ phase is effected under the conditions for forming neither twin plane nor screw dislocation defect (that is, in such a way that the proportion of the $AgX_1$ seed grains having twin planes and/or screw dislocations to be formed is 5% or less, preferably from 0 to 1%, more preferably from 0 to 0.1%, by number of the seed grains) and that the second formation of the $AgX_2$ phase is effected under the conditions suitable for creating the intended screw dislocation defects.

The proportion of the tabular to the sum of all the seed grains formed by the seed grain formation step is preferably 20% or less, more preferably from 0.1 to 10%, by number of the seed grains. Where the probability of the creation of the defects is lowered, the proportion of thick grains to be formed is decreased while the proportion of tabular grains to be formed is increased. In view of the fact, it is considered that the tabular grains formed will be those having only one screw dislocation, while the thick grains will have two or more screw dislocation defects and will grow anisotropically in the x, y and z directions. In order to inhibit the formation of thick grains while only thin tabular grains are intended to be formed, the formation of the defects must be effected uniformly in different grains. In this case, it is desired that the addition of the solution to be added to the reaction system for the purpose of creating the defects is effected by uniform mixing addition. Preferably, the solution is added to the reaction system through a porous material, more preferably a hollow tubular, rubbery elastic porous membrane, that has been located in the reaction system. For the details of such uniform mixing addition, referred to are JP-A-3-21339, JP-A-4-193336, JP-A-4-283741, and Japanese Patent Application Nos. 4-240283, 4-302605, 5-25314.

According to the present invention, tabular seed grains are not substantially formed during the formation of the $AgX_1$ seed grains but they are substantially created by the formation of the halogen composition gap planes. The wording "substantially created" as referred to herein indicates that 30% by number or more, preferably from 50 to 100% by number, more preferably from 80 to 100% by number, of the sum of all the finally obtainable tabular grains are created in this stage. It is more preferred that the defects are formed substantially due to the halogen composition gaps in the $Br^-$ content and the $Cl^-$ content. To the wording "substantially", the same definition as above shall apply.

The present invention includes such an embodiment that the gap preferably involves a difference of 0.1 to 100 mol %, more preferably 1 to 100 mol %, further more preferably 10 to 100 mol % in terms of the content of at least one of sulfur, selenium, tellurium, $SCN^-$, $SeCN^-$, $TeCN^-$, $CN^-$, metal ions other than $Ag^+$, and complexes of the metal ions (examples of a ligand including $X^-$ ligand, $CN^-$ ligand, isocyano, nitrosyl, thionitrosyl, amino, and hydroxyl) between the adjacent layers. The representative examples of the metal ion other than $Ag^+$ include metal ions belonging to the group VIII in the periodic table, Cu, Zn, Cd, In, Sn, Au, Hg, Pd, Cr and Mn.

Additionally, the present invention includes such embodiments that the AgX grain is doped with the aforementioned impurity ions in whole grain, that the AgX grain is doped with the impurity ions at a specific position of the grain, and that the AgX grain is doped with the impurity ions in the grain in such a manner that the impurity ions are located at the position within 0.1 $\mu$m from the surface of the grain. The doping concentration in this case is preferably $10^{-8}$ to $10^{-1}$ mol/mol of AgX, more preferably $10^{-7}$ to $10^{-2}$ mol/mol of AgX.

With respect to the specific examples of these impurity ions and the details of method of doping to the AgX phase, *Research Disclosure*, Vol. 307, Item 307105 (November, 1989), U.S. Pat. Nos. 5,166,045, 4,933,272, 5,164,292, 5,132,203, 4,269,927, 4,847,191, 4,933,272, 4,981,781 and 5,024,931, JP-A-4-305644, JP-A-4-321024, JP-A-1-183647, JP-A-2-20853, JP-A-1-285941 and JP-A-3-118536 can be referred to.

According to the present invention, seed grain formation may be carried out in such a way that the frequency of forming rod-like seed grains having one screw dislocation, twin plane seed grains and tabular seed grains having the defects for accelerating their growth in the three-dimensional direction is small while the frequency of forming the tabular grains is large. For this, the best conditions for seed grain formation may be determined by design of experiment or by trial-and-error in accordance with different practical cases. In order to prevent the generation of twin plane grains, it is preferred to employ the above-mentioned adsorbent which may selectively adsorb on {100} planes of the growing grains.

During seed grain formation, the silver salt solution and/or the $X^-$ salt solution may contain a dispersion medium in order to form uniform seed grains. The concentration of the dispersion medium in the reaction system is preferably 0.1% by weight or more, more preferably from 0.1 to 2% by weight, further preferably from 0.2 to 1% by weight. As the dispersion medium, more preferred is a low molecular weight gelatin having a molecular weight of from 3,000 to 50,000.

The concentration of the dispersion medium in a vessel solution is preferably 0.1% by weight or more, more preferably from 0.2 to 5% by weight, further preferably from 0.3 to 2% by weight. The solutions have pH of from 1 to 12, preferably from 3 to 10, more preferably from 5 to 10.

(2) Ripening

It is impossible to exclusively form only the tabular grains during the seed grain formation step. Therefore, grains other than tabular grains are made to disappear by Ostwald ripening in the next ripening step. The ripening temperature is preferably higher than the seed grain formation step temperature by 10° C. or more, more preferably 20° C. or more. In general, the ripening temperature falls between 50° C. and 90° C., preferably between 60° C. and 80° C. If it is 90° C. or higher, the ripening is desirably conducted under atmospheric pressure or higher, more desirably under elevated pressure of 1.2 times or higher atmospheric pressure. For the details of such pressure ripening, referred to is Japanese Patent Application No. 3-343180 (corresponding to JP-A-5-173267). It is preferred that the ripening is conducted in the atmosphere for forming {100} planes, concretely under the conditions for forming the cubic or tetradecahedral grains defined hereinabove.

Where the $Br^-$ content in the seed grains formed is preferably 70 mol % or more, more preferably 90 mol % or more, the excess ion concentrations of $Ag^+$ and $Br^-$ in the solution during the ripening are desirably $10^{-2.3}$ mol/liter or less, more preferably $10^{-2.6}$ mol/liter or less. The solution preferably has pH of 2 or more, more preferably from 2 to 11, further preferably from 2 to 7. After the ripening has been finished under the defined pH and pAg conditions, non-defective, cubic, fine grains essentially disappear while tabular grains preferentially grow in the direction of their edges. With departing from the defined excess ion concentration conditions, the preferential growth of the edges is lowered so that the rate of non-tabular grains disappearing is retarded, while the growth of the grains in the direction of their essential planes is accelerated so that the aspect ratio of the grains grown is decreased. Addition of an AgX solvent during the ripening promotes the ripening. However, since the ripening conditions vary depending on the halogen composition of AgX grains being ripened, the pH, the pAg, the gelatin concentration, the temperature, the concentration of the AgX solvent, etc. Therefore, the optimum conditions may be selected by try-and-error.

Where the $Cl^-$ content in the seed grains formed is preferably 30 mol % or more, more preferably 60 mol % or more further preferably 80 mol % or more, the excess $Cl^-$ ion concentration in the solution during the ripening is preferably 3 or less, more preferably from 1 to 2.5, further preferably from 1 to 2, in terms of pCl. The solution preferably has pH of from 2 to 11, more preferably from 3 to 9.

Apart from the above, the ripening may also be conducted while a silver salt solution and an $X^-$ salt solution are added by a double jet method under low supersaturation condition. Under low supersaturation condition, the active growing points having a screw dislocation grow preferentially while fine grains not having the defects disappear. This is because the degree of supersaturation necessary for forming semi-stable seed grains for the growth on the active growing points is low while the degree of supersaturation necessary for forming such semi-stable seed grains on the non-defective planes is high. The degree of low supersaturation as referred to herein preferably corresponds to 30% or less, more preferably 20% or less, of the degree of supersaturation attainable by critical addition. The critical addition as referred to herein indicates a maximum rate for adding the silver salt solution and the $X^-$ salt solution without generation of any new seed grains.

The emulsion of the present invention may be obtained after the ripening. However, since the emulsion just formed after the ripening contains only a small amount of the intended AgX grains and since it is impossible to freely control the grain size of the grains formed, an additional crystal-growing step which will be mentioned below is generally carried out after the ripening.

(3) Crystal Growing Step

In the above-mentioned ripening step, the proportion of the tabular grains is elevated. Afterwards, the grains are grown to the desired sizes in the next crystal-growing step. In the crystal-growing step, the ripened tabular grains are grown under the condition for forming the {100} planes defined hereinabove. For this, for example, mentioned are 1) a method of adding ionic solutions where a silver salt solution and an $X^-$ salt solution are added so as to grow the tabular grains, 2) a method of adding fine grains where fine AgX grains are previously formed and the fine grains are added so as to grow the tabular grains, and 3) a method comprising the combination of the previous two methods 1) and 2).

To grow the tabular grains preferentially in the direction of their edges, the grains may be grown under the condition of low supersaturation. The degree of low supersaturation as referred to herein preferably corresponds to 35% or less, more preferably from 2 to 20%, of the degree of supersaturation attainable by critical addition.

In general, heretofore, the lower the degree of supersaturation, the broader the grain size distribution of the thus-grown grains. The reason is as follows: Since the frequency of the collision of the solute ions against the surfaces of the grains is low under the condition of lower supersaturation, the frequency of the generation of the growth-seed grains is low so that the step of forming the growth-seed grains progresses at a constant rate. Since the probability of forming the growth-seed grains is proportional to their area under the condition of employing uniform solutions, the grains having larger growing areas are grown earlier. Accordingly, large grains are grown earlier than small grains whereby the grain size distribution containing the thus-grown grains becomes broader. The growing behavior is observed in regular crystal grains having no twin plane and in tabular grains having parallel twin planes. Namely, for the regular crystalline grains, the linear growing speed thereof is proportional to the surface area of the grain, while, for the tabular-grains having parallel twin planes, it is proportional to the length of the periphery (or the length of the trough line) of the edges of the grain.

On the other hand, for the grains of present invention, since only the screw dislocation defect d1 acts as the growth initiating point in the edge plane of the grain, the frequency of forming the grown seed grains is proportional to the number of d1. Therefore, if the value of (number of d1/grain) is unified, the grains may be grown uniformly even under the condition of low supersaturation so that the value of the fluctuation coefficient of the grown grains will become smaller with increase of the mean grain size of them. By unifying the sizes of the seed grains to be formed by the seed grain formation step and by unifying the intergranular characteristics of the halogen composition gap planes of the seed grains, the value of (number of d1/grain) may be unified. For forming seed grains having a uniform size, the generation of new seed grains shall be finished within a short period of time and then the thus-generated seed grains shall be grown under the condition of high supersaturation without generating any additional new seed grains whereby the size of the thus grown seed grains may be unified. If the step is conducted at low temperatures, seed grains having a small and uniform size may be formed. The low temperatures as referred to herein are not higher than 50° C., preferably falling within the range of from 5 to 40° C., more preferably from 5 to 30° C. The short period of time as referred to herein is preferably 3 minutes or shorter, more preferably one minute or shorter, further preferably from 1 to 20 seconds.

When the tabular grains are grown under the condition of low supersaturation, the monomers of the solute ions that have been adsorbed onto their main planes desorb therefrom before they become dimers or higher n-polymers to constitute adsorption-desorption equilibrium, and finally they are trapped into the edges of the grown grains. Namely, considering the chemical equilibrium of the solute ions existing on the main planes and edge planes of the growing grains and in the solution phase therearound on the basis the energy diagram and applying thereto the Van't Hoff's equation of reaction isobar ($dLnKp/dT=\Delta H^0/RT^2$) to be obtained from the Gibbs-Helmholtz equation and the equation of chemical equilibrium ($\Delta G^0 = -RTLnKp$) thereby plotting the data of the variation in the length of the grown main planes and of the grown edge planes, relative to the varying temperatures, the phenomenon may be understood. In general, when the temperatures are higher, then the desorption of the solute ions from the main planes is accelerated so that the edge planes are grown selectively. Where Kp=(length of the growth of edge plane/length of the growth of main plane), $\Delta H$ may be approximately 13 KCal/mol.

When the degree of supersaturation during the growth of the grains becomes higher, the frequency of forming grown seed grains also on the non-defective planes becomes larger. Namely, the tabular grains will be grown also in the direction of their thickness under this condition so that the thus-grown tabular grains are to have a lowered aspect ratio. This indicates the mode of poly-nuclear growth. When the degree of supersaturation is elevated further more, the frequency of forming the growth-seed grains is increased and the growing mode is then continuously changed to a diffusion-controlled grain growth.

According to the method of adding an emulsion of fine grains, an emulsion of fine AgX grains having a grain size of 0.15 $\mu$m or less, preferably 0.1 $\mu$m or less, more preferably from 0.006 to 0.06 $\mu$m is added to the tabular grains whereby the tabular grains are further grown by Ostwald ripening. The emulsion of fine grains may be added either continuously or intermittently. The emulsion of fine grains may be prepared continuously by mixing an $AgNO_3$ solution and an $X^-$ salt solution in a mixer located near to the reaction container, and it is immediately and continuously added to the reaction container. Alternatively, the emulsion may be batchwise prepared in a separate container and thereafter it may be added to the reaction container either continuously or intermittently. The emulsion of fine grains may be added either as it is or after it is dried to a dry powder. It is preferred that the fine grains do not substantially contain multi-layered twin-plane grains. The multi-layered twin-plane grains as referred to herein are those having two or more twin planes per one grain. The wording "do not substantially contain" as referred to herein means that the proportion of the multi-layered twin-plane grains is 5% or less, preferably 1% or less, more preferably 0.1% or less. Further preferably, the fine grains do not substantially contain also single-layered twin-plane grains. Still further preferably, they do not substantially have any screw dislocations. To the wording "do not substantially contain" or "do not substantially have" as referred to herein, the same as above shall apply.

Regarding the halogen composition of the fine grains, they are AgCl, AgBr or AgBrI (where the $I^-$ content is preferably 10 mol % or less, more preferably 5 mol % or less) grains or comprise mixed crystals of two or more of them. For the other details of the fine grains, referred to is Japanese Patent Application No. 4-214109.

For the methods of preparing the grains having the structures of FIG. 1(*a*) to FIG. 1(*g*) and the other conditions for the preparation of the AgX emulsion of the present invention than those mentioned above, referred to are Japanese Patent Application No. 4-77261 (corresponding to JP-A-5-281640), Japanese Patent Application Nos. 4-145031 and 4-214109 and the references which will be mentioned hereinafter.

Using the thus-obtained grains as host grains, epitaxial grains may be formed. Using them as core grains, grains having dislocations in the inside thereof may also be formed. In addition, using them as substrate grains, an additional AgX layer having a halogen composition different from that of the substrate grain may be laminated thereover to form various grains having various known structures. Regarding these, the references which will be mentioned hereinafter may be referred to. In general, chemical sensitization nuclei are formed in the thus-obtained grains.

In the present invention, it is desired that the sites of the chemical sensitization seed grains, if formed, and the number of the seed grains per $cm^2$ are controlled. Regarding this, referred to are JP-A-2-838, JP-A-2-146033, JP-A-1-201651, JP-A-3-121445, JP-A-64-74540, Japanese Patent Application No. 3-140712, and Japanese Patent Application Nos. 3-73266, and 3-115872 (corresponding to JP-A-4-308840 and JP-A-4-343348, respectively).

Using the tabular grains thus formed as core grains, an emulsion for forming latent images in the shallow inside of the grains may be prepared. Also possible is formation of core/shell grains, using the tabular grains. Regarding these, referred to are JP-A-59-133542, JP-A-63-151618 and U.S. Pat. Nos. 3,206,313, 3,317,322, 3,761,276, 4,269,927 and 3,367,778.

The AgX grains produced by the method of the present invention may be blended with one or more other kinds of AgX emulsions. The ratio of the blending may be varied within the range of from 1.0:1 to 0.01:1 to determine the optimum blending ratio.

The optimum pH value of the reaction solution in the above-mentioned step for forming the grains of the present invention may be selected from the range of generally from 1 to 12, preferably from 2 to 11. The additives which may be added to the emulsion of the present invention from its formation to its coating are not specifically defined but any known conventional photographic additives may be employed. For instance, employable are AgX solvents, dopants to AgX grains (e.g., compounds of Group VIII noble metals, other metal compounds, chalcogen compounds, SCN compounds such as $Na^+SCN^-$), dispersion media, antifoggants, sensitizing dyes (e.g., blue-sensitizing dyes, green-sensitizing dyes, red-sensitizing dyes, infrared-sensitizing dyes, panchromatic-sensitizing dyes, ortho-sensitizing dyes), supersensitizers, chemical sensitizers (e.g., sulfur compounds, selenium compounds, tellurium compounds, gold compounds, compounds of Group VIII noble metals, phosphorus compounds, rhodanium compounds, reduction sensitizers—these may be used singly or as a combination of two or more of them), foggants, emulsion flocculating agents, surfactants, hardening agents, dyes, color image forming agents, color photographic additives, soluble silver salts, latent image stabilizers, developing agents (e.g., hydroquinone compounds), pressure desensitization inhibitors, matting agents, etc.

The AgX grains and the AgX emulsions produced by the present invention may be used in all known conventional photographic materials. For instance, they may be used in black-and-white silver halide photographic materials (e.g., X-ray photographic materials, photographic materials for photomechanical process, printing papers, negative films, micro films, direct positive photographic materials, dry plates containing ultra-fine grains (for example, for LSI photo-masking, shadow-masking, liquid crystal-masking)) and also in color photographic materials (e.g., negative films, printing papers, reversal films, direct positive color photographic materials, photographic materials for silver dye bleaching method). In addition, they may also be employed in photographic materials for diffusion transfer process (e.g., elements for color diffusion transfer process, elements for silver salt diffusion transfer process), heat-developable photographic materials (for black-and-white development or color development), high-density digital-recording photographic materials, photographic materials for holography, etc.

The amount of silver to be coated in preparing such photographic materials may be selected from the range of 0.01 $g/m^2$ or more. There are no limitations for the constitutions of the photographic materials (for example, with respect to the molar ratio of silver in the constitutive layers to the couplers therein, the proportions of silver in the constitutive layers), the processes for exposure and development of them, the devices for preparing them, and the means for emulsifying and dispersing photographic additives in the coating compositions. All known conventional photographic modes and techniques may be employed for them. Regarding known conventional photographic additives, photographic materials and their constitutions, processes for exposure and development and devices for producing photographic materials, which may be applicable to the present invention, the following references may be referred to.

*Research Disclosure*, Vol. 176, Item 17643 (December, 1978); ibid., Vol. 307, Item 307105 (November, 1989); Duffin, *Photographic Emulsion Chemistry*, Focal Press, New York (1966); E. J. Birr, *Stabilization of Photographic Silver Halide Emulsions*, Focal Press, London (1974); T. H. James, *The Theory of Photographic Process,* 4th Ed., MacMillan, New York (1977); P. Glafkides, *Chimie et Physique Photographigues,* 5th Ed., Edition de l'Usine Nouvelle, Paris (1987); ibid., 2nd Ed., Paul Montel, Paris (1957); V. L. Zelikman et al., *Making and Coating Photographic Emulsion*, Focal Press (1964); K. R. Hollister, *Journal of Imaging Science*, Vol. 31, pp. 148–156 (1987); J. E. Maskasky; ibid., Vol. 30, pp. 247–254 (1986); ibid., Vol. 32, pp. 160–177 (1988); ibid., Vol. 33, pp. 10–13 (1989); Frieser et al., *Die Grundlagen Der Photographischen Prozesse Mit Silverhalogeniden*, Akademische Verlaggesellschaft, Frankfurt (1968); *Monthly Journal of Nippon Chemical Society*, (December, 1984), pp. 18–27; *Journal of Nippon Photographic Society*, Vol. 49, pp. 7–12 (1986); ibid., Vol. 52, pp. 144–166 (1989); ibid., Vol. 52, pp. 41–48 (1989); JP-A-58-113926 to JP-A-58-113928, JP-A-59-90841, JP-A-58-111936, JP-A-62-99751, JP-A-60-143331, JP-A-60-143332, JP-A-61-14630, JP-A-62-6251, JP-A-63-220238, JP-A-63-151618, JP-A-63-281149, JPA-59-133542, JP-A-59-45438, JP-A-62-269958, JP-A-63-305343, JP-A-59-142539, JP-A-62-253159, JP-A-62-266538, JP-A-63-107813, JP-A-64-26839, JP-A-62-157024, JP-A-62-192036, JP-A-1-297649, JP-A-2-1276355, JP-A-1-158429, JP-A-2-42, JP-A-2-24643, JP-A-1-146033, JP-A-2-838, JP-A-2-28638, JP-A-3-109539, JP-A-3-175440, JP-A-3-121443, JP-A-2-73245, JP-A-3-119347; U.S. Pat. Nos. 4,636,461, 4,942,120, 4,269,927, 4,900,652 and 4,975,364; EP-A-0355568; and Japanese Patent Application Nos. 2-326222, 2-415037, 2-266615, 2-43791, 3-160395, 2-142635, 3-146503 and 4-77261 (corresponding to JP-A-4-193336, JP-A-4-229852, JP-A-3-200952, JP-A-3-246534, JP-A-5-11377, JP-A-4-34544, JP-A-4-226449 and JP-A-5-281640, respectively).

The present invention will be explained in more detail by means of the following examples, which, however, are not intended to restrict the scope of the present invention.

EXAMPLE 1

An aqueous gelatin solution (comprising 1.2 liters of $H_2O$, 20 g of de-ionized, alkali-processed gelatin (EA-Gel) and 0.8 g of NaCl and having pH of 6.0) was put in a reactor and kept at 50° C. While stirring, Ag-1 Solution and X-1 Solution were added thereto both at a flow rate of 50 ml/min by a double jet method, over a period of 15 seconds.

Ag-1 Solution contained 20 g of $AgNO_3$, 0.6 g of low-molecular weight gelatin having a mean molecular weight of 20,000 (2M-Gel) and 0.2 ml of 1N-$HNO_3$ solution in 100 ml. X1 Solution contained 7 g of NaCl and 0.6 g of 2M-Gel in 100 ml.

Next, Ag-2 Solution (containing 4 g of $AgNO_3$, 0.6 g of 2M-Gel and 0.2 ml of 1N-$HNO_3$ solution in 100 ml) and X-2 Solution (containing 2.8 g of KBr and 0.6 g of 2M-Gel in 100 ml) were added thereto both at a flow rate of 70 ml/min by a double jet method, over a period of 15 seconds. Next, Ag-1 Solution and X-1 Solution were added thereto both at a flow rate of 25 ml/min by a double jet method, over a period of 2 minutes. Then, 15 ml of NaCl (0.1 g/ml) were added thereto, and the reaction system was heated to 70° C. and ripened for 5 minutes at the elevated temperature. Ag-1 Solution and X-1 Solution were added thereto both at a flow rate of 10 ml/min by a double jet method, over a period of 15 minutes. Next, 0.2 mols of an emulsion of fine AgCl grains having a mean grain size of 0.07 $\mu$m, in which the proportion of the grains having twin planes or screw dislocations was 0.1% or less, were added thereto, and the system was ripened for further 15 minutes. The temperature of the system was lowered to 40° C. and the pH thereof was made 2.0, and the system was stirred for 20 minutes. Afterwards, the pH was made 5.2, and only $10^{-3}$ mols of KBr–1 Solution (KBr: 1 g/100 ml) were added thereto and stirred for 5 minutes. Next, the following Sensitizing Dye 1 was added thereto in an amount of 65% of the amount of saturated adsorption and stirred for 5 minutes.

A flocculating agent was added, the temperature was lowered to 27° C., the pH was made 4.0, and the emulsion was washed with water by ordinary flocculation. An aqueous gelatin solution was added, the temperature was elevated to 40° C., and the pH of the emulsion was adjusted at 6.2 while the pCl thereof at 2.8. The emulsion was sampled and its TEM (i.e., transmission electron microscope) image was observed. From the image, it was found that the AgX grains formed contained tabular grains having right-angled parallelogramic {100} planes, as the main planes, and having an aspect ratio of 3 or more, in a proportion of 80% of the projected areas of all the grains. The tabular grains had a mean grain size of 1.1 $\mu$m and a mean aspect ratio of 7.0. The fluctuation coefficient of the grain size distribution of the tabular grains was 0.27.

Next, the temperature was elevated to 55° C., and an aqueous hypo solution (0.01% by weight) was added to the emulsion in an amount of $5\times10^{-6}$ mol/mol of AgX. After 5 minutes, the following gold sensitizing agent was added in an amount of $1.2\times10^{-6}$ mol/mol of AgX. 30 minutes after the addition, the temperature was lowered to 40° C. The following antifoggant 1 was added in an amount of $2\times10^{-3}$ mol/mol of AgX. Then, the following viscosity-increasing agent and coating aid (i.e., surfactant) were added, and the resulting emulsion was coated on a TAC (i.e., triacetyl cellulose) base along with a protective layer thereon. After drying, a coated sample (Sample A) was obtained.

Sensitizing Dye 1

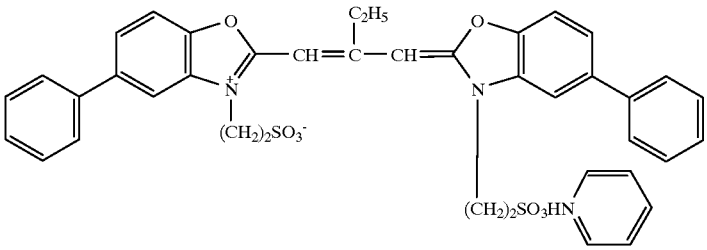

Gold Sensitizing Agent $HAuCl_3$:NaSCN=1:20 mole ratio

Antifoggant 1

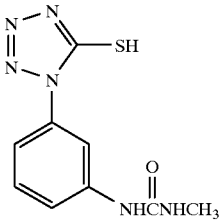

Viscosity-increasing Agent

Poly(sodium p-styrenesulfonate)

Coating Aid

Sodium dedecylbenzenesulfonate

EXAMPLE 2

An aqueous gelatin solution (comprising 1.2 liters of $H_2O$, 24 g of EA-Gel and 5.0 ml of 1N-$KNO_3$ solution and having pH of 8.0) (Gelatin Solution 2) was put in a reactor and kept at 40° C. Ten ml of $AgNO_3$-1 Solution ($AgNO_3$:0.1 g/ml) was added thereto. Ag-1 Solution and X-21 Solution (containing 14 g of KBr and 0.6 g of 2M-Gel in 100 ml) were added thereto both at a flow rate of 50 ml/min by a double jet method, over a period of 15 seconds. Next, Ag-22 Solution (containing 2.8 g of $AgNO_3$, 0.6 g of 2M-Gel and 0.2 ml of 1N-$HNO_3$ solution in 100 ml) and X-22 Solution (containing 1 g of NaCl and 0.6 g of 2M-Gel in 100 ml) were added thereto both at a flow rate of 60 ml/min by a double jet method, over a period of 25 seconds. Next, Ag-1 Solution and X-21 Solution were added thereto both at a flow rate of 50 ml/min by a double jet method, over a period of 50 seconds. Then, the pH was made 4.0 by adding 1N-$HNO_3$ solution, the silver potential was adjusted to 170 mV by adding KBr2 Solution (2 g/100 ml), and the temperature was elevated to 65° C. After thus heated, this was ripened for 10 minutes, and 0.2 mols of an emulsion of fine AgBr grains having a mean grain size of 0.04 μm, in which the proportion of the grains having twin planes or screw dislocations was 0.1% or less, were added. This was ripened for further 10 minutes. Afterwards, 0.2 mols of the same emulsion of fine AgBr grains were added, and this was ripened for still further 15 minutes.

A flocculating agent was added, the temperature was lowered to 27° C., the pH was made 4.0, and the emulsion was washed with water by ordinary flocculation. An aqueous gelatin solution was added, the temperature was elevated to 40° C., and the pH of the emulsion was adjusted at 6.4 while the pBr thereof at 2.8. The emulsion was sampled and its TEM image was observed. From the image, it was found that the AgX grains formed contained tabular grains having right-angled parallelogramic {100} planes, as the main planes, and having an aspect ratio of 3 or more, in a proportion of 82% of the projected areas of all the grains. The tabular grains had a mean grain size of 0.95 μm and a mean aspect ratio of 7.2. The fluctuation coefficient of the grain size distribution of the tabular grains having an aspect ratio of 3.0 or more was 0.25.

Next, the temperature was elevated to 50° C., and an antifoggant, TAI (4-hydroxy-6-methyl-1,3,3a,7-tetrazaindene) was added to the emulsion in an amount of $2\times10^{-3}$ mol/mol of AgX. Then, the following Sensitizing Dye 2 was added thereto in an amount of 70% of the amount of saturated adsorption and stirred for 10 minutes. Then, the temperature was elevated to 55° C., and a gold sensitizing agent (comprising chloroauric acid and NaSCN in a molar ratio of 1:20) was added in an amount of $6\times10^{-6}$ mol/mol of AgX in terms of gold. Next, an aqueous hypo solution was added in an amount of $6\times10^{-6}$ mol/mol of AgX. After ripened for 25 minutes, this was cooled to 40° C. The above-mentioned viscosity-increasing agent and coating aid were added, and the resulting emulsion was coated on a TAC base along with a protective layer thereon. After drying, a coated sample (Sample B) was obtained.

Sensitizing Dye 2

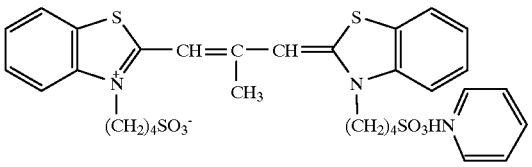

EXAMPLE 3

Gelatin Solution 2 was put in a reactor and kept at 40° C. 5 ml of $AgNO_3$-1 Solution were added thereto. Ag-1 Solution and X-31 Solution (containing 13.7 g of KBr, 0.43 g of KI and 0.6 g of 2M-Gel in 100 ml) were added thereto both at a flow rate of 50 ml/min by a double jet method, over a period of 15 seconds. Next, Ag-22 Solution and X-22 Solution were added thereto both at a flow rate of 60 ml/min by a double jet method, over a period of 27 seconds. Next, Ag-1 Solution and X-31 Solution were added thereto both at a flow rate of 50 ml/min by a double jet method, over a period of 50 seconds. Then, the pH was made 4.5 by adding 1N-$HNO_3$ solution, the silver potential was adjusted to 180 mV by adding KBr2 Solution, and the temperature was elevated to 70° C. After thus heated, this was ripened for 10 minutes, and 0.2 mols of an emulsion of fine AgBrI grains having an $I^-$ content of 1 mol % and a mean grain size of 0.04 $\mu$m, in which the proportion of the grains having twin planes or screw dislocations was 0.1% or less, were added. This was ripened for further 12 minutes. Afterwards, 0.2 mols of the same emulsion of fine AgBrI grains were added, and this was ripened for still further 20 minutes.

A flocculating agent was added, the temperature was lowered to 27° C., the pH was made 4.0, and the emulsion was washed with water by ordinary flocculation. An aqueous gelatin solution was added, the temperature was elevated to 40° C., and the pH of the emulsion was adjusted at 6.4 while the pBr thereof at 2.8. The emulsion was sampled and its TEM image was observed. From the image, it was found that the AgX grains formed contained tabular grains having right-angled parallelogramic {100} planes, as the main planes, and having an aspect ratio of 3 or more, in a proportion of 78% of the projected areas of all the grains. The tabular grains had a mean grain size of 1.0 $\mu$m and a mean aspect ratio of 7.0. The emulsion was thereafter processed in the same manner as in Example 2 and coated on a TAC base in the same manner as in Example 2 to obtain a coated sample (Sample C).

The processes of Examples 1 to 3 were repeated each 12 times. The fluctuation coefficient of the tabular grains in the emulsions thus obtained was 0.1 or less in every group of Examples 1 to 3, in terms of the dispersion of the mean grain size obtained from the diameters of circles corresponding to the projected areas of the grains. From the results, the good reproducibility of the processes of Examples 1 to 3 was verified.

Comparative Example 1

The process of Example 2 of JP-B-64-8323 (corresponding to U.S. Pat. No. 4,386,156) was carried out 12 times. The process of Example 2 of U.S. Pat. No. 4,386,156 was as follows. A solution of 60 g of inert gelatin in 3,000 ml of distilled water was prepared. The pH of this solution was adjusted at 6.0 and the solution was maintained at 40° C. In 20 seconds, a silver nitrate 1 molar solution and a potassium bromide 1 molar solution were introduced in this gelatin solution by the double jet method, the flow rate for each solution being 140 ml per minute. The pAg rose to 7.40 and it was lowered to 6.99 by adding silver nitrate. The pH at the end of precipitation was 6.03. Physical ripening was then carried out. The average length of the edge of the tabular grains is 0.7 $\mu$m, the average thickness is 0.06 $\mu$m, and their average aspect ratio is greater than 11.

The mean grain size of the tabular grains in the emulsions thus obtained greatly dispersed from 0.6 $\mu$m to 1.5 $\mu$m, calculated from the diameters of circles corresponding to the projected areas of the grains. The fluctuation coefficient of the dispersion of the mean grain size was more than 0.5.

Comparative Example 2

The process of Example 3 of EP-A-0534395 was carried out. The fluctuation coefficient of the grain size distribution of the tabular grains having an aspect ratio of 3 or more in the emulsion thus obtained was more than 0.5. The emulsion was a poly-dispersed one. The proportion of the projected areas of the tabular grains to the sum of the projected areas of all the AgX grains in the emulsion was 40% or less, or that is, the proportion was low. The same process was repeated 12 times. The fluctuation coefficient of the tabular grains in the emulsions thus obtained was more than 0.5, in terms of the dispersion of the mean grain size obtained from the diameters of circles corresponding to the projected areas of the grains.

The emulsion obtained in Comparative Example 1 was processed in accordance with the same sensitizing step as in Example 2; and that obtained in Comparative Example 2 was as in Example 1.

The coated samples obtained in Examples 1 to 3 and those obtained in Comparative Examples 1 and 2 were exposed each through a blue filter and an optical wedge for $10^{-2}$ seconds, developed, processed using a stopper, a fixer and a washing solution, and dried. The photographic properties of the processed samples of Examples 1 to 3 were superior to those of Comparative Examples 1 and 2 with respect to the sensitivity and the graininess. The development of the samples of Example 1 and Comparative Example 2 was carried out, using a developer that had been prepared by substituting KBr in MAA-1 Developer (refer to Journal of Photographic Science, Vol. 23, pp. 249–256, 1975) by the same molar amount of NaCl, at 20° C. for 5 minutes. The development of the samples of Examples 2 and 3 and Comparative Example 1 was carried out, using MAA-1 Developer at 20° C. for 10 minutes.

As has been explained in detail hereinabove, the AgX emulsions of the present invention are superior to the conventional AgX emulsions containing tabular grains having {100} planes as the main planes, with respect to the reproducibility, the sensitivity and the graininess.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising at least a dispersion medium and silver halide tabular grains, wherein said silver halide tabular grains are prepared at least by a seed grain formation step followed by a ripening step and then a grain growth step, wherein the silver halide tabular grains having, as the main planes, {100} planes and having an aspect ratio (diameter/thickness) of 1.5 or more and are present in a proportion of 30% or more of the sum of the projected areas of all the silver halide tabular grains, wherein the seed grains, which during said grain growth step are grown to become said silver halide tabular grains, are formed during said seed grain formation step and said seed grains contain at least one halogen composition gap plane, and one of said at least one halogen composition gap plane is expressed by $AgX_1/AgX_2$, which is formed by laminating an $AgX_2$ layer on an $AgX_1$ nucleus, and the halide content $X_1$ differs from the halide content $X_2$ by at least 10 mol % in terms of $Br^-$ content.

2. The silver halide emulsion as claimed in claim 1, wherein the tabular silver halide grains have a $Cl^-$ content of 49 mol % or less.

3. The silver halide emulsion as claimed in claim 1, wherein said tabular grains further comprise a second halogen composition gap plane in said seed grains, wherein the halide content $X_1$ differs from the halide content $X_2$ by at least 10 mol % in terms of $Cl^-$ or $Br^-$ content or at least 5 mol % in terms of $I^-$ content.

4. The silver halide emulsion as claimed in claim 1, wherein the difference between $X_1$ and $X_2$ is from 30 to 100 mol % in terms of the $Br^-$ content.

5. The silver halide emulsion as claimed in claim 1, wherein said tabular grains have an aspect ratio of from 3 to 25.

6. The silver halide emulsion as claimed in claim 1, wherein said tabular grains constitute from 60 to 100% of all of the silver halide grains in the emulsion, based on projected area of all of the silver halide grains.

7. The silver halide emulsion as claimed in claim 1, wherein said tabular grains have a thickness in the range of from 0.03 to 0.3 $\mu$m.

8. The silver halide emulsion as claimed in claim 1, wherein said tabular grains exhibit a variation coefficient of grain size distribution of from 0 to 0.4.

9. The silver halide emulsion as claimed in claim 1, wherein said seed grains have an equivalent diameter, which corresponds to the diameter of a circle having the same area as the projected area of the seed grains, of 0.3 $\mu$m or less.

10. The silver halide emulsion as claimed in claim 1, wherein said ripening step was conducted at a temperature that is at least 10° C. higher than the seed grain formation step temperature.

11. The silver halide emulsion as claimed in claim 1, wherein the halogen composition gap plane $AgX_1/AgX_2$ is formed by the following steps:

a) $AgX_1$ seed grains are formed, b) thereafter an $X^-$ salt solution is added thereto, causing halogen conversion of the $AgX_1$, wherein the $X^-$ salt has a halide composition that forms a less soluble silver halide salt than the $AgX_1$.

* * * * *